United States Patent [19]

Thomas

[11] Patent Number: 4,793,918

[45] Date of Patent: Dec. 27, 1988

[54] GRAVITY SEPARATOR

[75] Inventor: James A. Thomas, Rocky Ford, Colo.

[73] Assignee: Oliver Manufacturing Co., Inc., Rocky Ford, Colo.

[21] Appl. No.: 883,503

[22] Filed: Jul. 8, 1986

[51] Int. Cl.[4] ..... B03B 4/00

[52] U.S. Cl. ..... 209/467; 209/504; 209/508

[58] Field of Search ..... 209/466, 467, 479, 480, 209/469, 503, 504, 508, 489, 488, 468, 486

[56] References Cited

U.S. PATENT DOCUMENTS

| | | | |
|---|---|---|---|
| 1,417,682 | 5/1922 | Overstrom | 209/504 |
| 2,079,059 | 5/1937 | Winkleman | 209/508 |
| 2,206,337 | 7/1940 | Steele | 209/467 |
| 2,325,340 | 7/1943 | Oberdick | 209/504 |
| 2,427,423 | 9/1947 | Shawcros | 209/504 |
| 2,429,543 | 10/1947 | Bastanchury | 209/508 |
| 2,759,605 | 8/1956 | Steele | 209/467 |
| 3,075,644 | 1/1963 | Ambrose | 209/503 |
| 3,444,996 | 5/1969 | Douglas et al. | 209/467 |
| 3,486,620 | 12/1969 | Stolle | 209/467 |
| 3,693,794 | 9/1972 | Oetiker | 209/467 |
| 3,807,554 | 4/1974 | Satake | 209/694 |
| 3,863,766 | 2/1975 | Oetiker | 209/469 |
| 3,926,793 | 12/1975 | Wise | 209/504 |
| 4,149,967 | 4/1979 | Masumoto | 209/467 |
| 4,251,358 | 2/1981 | Mozley | 209/504 |
| 4,282,091 | 8/1981 | Carter, Sr. | 209/467 |
| 4,583,645 | 4/1986 | Yamamoto | 209/691 |

OTHER PUBLICATIONS

Oliver Model 240 Gravity Separator Parts List, no date.

*Primary Examiner*—Robert B. Reeves
*Assistant Examiner*—Donald T. Hajec
*Attorney, Agent, or Firm*—Banner, Birch, McKie & Beckett

[57] ABSTRACT

A gravity separator for separating particulate material deposited onto a perforate separator deck is disclosed. The rate of separation is controlled by varying end raise and side tilt adjustments. These adjustments are made hydraulically and are remotely controlled. These adjustments are carried out while the machine is operating to avoid down-time. The feeder is located above the highest point of the separator deck to provide for faster separation. A blender assembly located at the high side of the deck accepts heavy material and conveys it to a discharge hopper. This provides for faster separation and allows the length of the deck to be decreased. A counterbalance is agitated in a manner to oppose and negate the motion of the deck. An air supply assembly with multiple fans is provided to direct a certain volume of air to separate areas of the separator deck.

24 Claims, 11 Drawing Sheets

GRAVITY SEPARATOR

TECHNICAL FIELD

The present invention is directed to the field of particulate material separating devices; and particularly to a gravity separator with an improved suspension system which allows side tilt and end raise adjustments to be made during operation of the separator from a remote location, as well as to an improved feed mechanism. The suspension system can be used with any type of vibrating deck separator, preferably with a gravity separator using a perforate deck and an upwardly directed air flow through the deck.

BACKGROUND OF THE INVENTION

Conventional gravity separators use an inclined perforated separator deck, which is vibrated in combination with an air flow directed vertically upwards through the separator deck to separate material into fractions or sections by weight. The inlet end of the deck is elevated with respect to the outlet end to define an end raise; and a first side of the deck is elevated with respect to a second side to define a side tilt. The air flow creats stratified layers, the lightest material being on top of the bed and the most dense material collecting on the bottom of the bed; and the deck vibration or agitation conveys the denser material up hill. The lighter material does not touch the deck surface and floats down hill thus, the vertically stratified bed of material is converted into a horizontally separated bed.

In order to control the rate at which the material flows over the deck, the end raise of the deck is adjusted. Also, to control the rate at which the heavier material is conveyed up hill, the side tilt or slope angle of the deck in the same plane as the direction of agitation is adjusted. One prior art technique for adjusting the end raise and side tilt in a gravity separator is shown in Steele U.S. Pat. No. 2,759,605, wherein two screw jacks are used to accomplish these adjustments. A major disadvantage with this type of adjustment assembly is the need to release and secure clamps before and after adjustments are made so that the machine must be stopped in order to allow the operator to make any adjustments. This can be both time consuming and costly since any down-time takes away from productive separating time.

Some prior art commercial gravity separators have end raise and tilt adjustment assemblies which can be changed while the machine is running. However, there is still a disadvantage to this type of adjustment assembly since it also requires the release and securement of clamps. Thus, when the machine is run during adjustment the loosening and tightening of the adjustment clamps reduces the quality of separation.

Conventional gravity separators used for seed separation have located the feeder to the deck at the low side of the deck. This, however, causes build up of material at the low side when the material is fed at a high rate. An artificial slope is thus formed by the material which is opposite to the slope of the deck, thereby working against separation. Such location of the feeder not only causes longer separation time, but also necessitates a longer deck.

SUMMARY OF THE INVENTION

The present invention is directed to a gravity separator for separating heavier particulate material from lighter particulate material. The separator includes a support framework, and a separator deck having an inlet end, an outlet end and first and second sides extending between the inlet and outlet ends. A suspension assembly supports the separator deck on the framework for vibratory motion with respect to the framework, with the inlet end of the deck elevated with respect to the outlet end of the deck to define an end raise and with the first side of the deck elevated with respect to the second side of the deck to define a side tilt. The suspension assembly includes an end raise adjusting mechanism for hydraulically adjusting the end raise of the separator decks. A mechanism is provided for vibrating the separator deck. A side tilt adjusting mechanism hydraulically adjusts the side tilt of the separator deck.

The suspension assembly preferably includes a discharge end support unit for supporting the discharge end of the separator deck and the end raise adjusting mechanism for supporting an input end of the separator deck and adjusting the end raise of the separator deck. The end raise adjusting mechanism includes: a bottom member; a top member spaced above the bottom member for supporting the inlet end of the separator; at least one hydraulic jack connected between the top and bottom members to move the top member with respect to the bottom member; a thrust member for transmitting vibratory thrust from the bottom member to the top member; the thrust member being hingedly connected at one end to the top member and at the other end to the bottom member; and an equalizer member for keeping the tilt angle between the top and bottom members equal during adjusting motion of the at least one hydraulic jack. One end of the equalizer member is hingedly connected to the bottom member; the other end of said equalizer member is hingedly connected to the top member; and an intermediate portion of the equalizer member between its opposite ends is hingedly connected to a portion of the thrust member.

The side tilt adjustment mechanism includes: a rotatable member extending between opposite ends of the separator deck; a torque arm extending from each end of the rotatable member; one of the torque arms being coupled to the discharge end support unit and the other of the torque arms being coupled to the bottom member of the end raise adjusting mechanism; and a mechanism for rotating the rotatable member to adjust the position of the torque arms and the side tilt of the separator deck.

Adjustments of end raise, side tilt, vibration speed and air volume control are accomplished through the use of hydraulics. A conventional hydraulic system uses a pump-motor combination to deliver the hydraulic fluid necessary to operate the controls. From the pump, the hydraulic fluid flows through a bank valve or control console which contains a conventional hydraulic control circuit capable of delivering fluid to each control function independently. The control console is conveniently located at the proper location for best viewing of the product during separation. This allows all adjustments to be made from one location and allows for settings to be at their optimum value to obtain the best separation.

The gravity separator in accordance with the present invention further includes a counterbalance assembly including a large weight which is agitated in a manner to oppose and negate the negative effects of the vibrating deck assembly. This prevents unwanted vibrations from being transmitted to the frame and the structure surrounding the machine. It makes installation and operation of the machine much simpler and provides for a smoother, quieter operation.

In a preferred embodiment, the particulate material feeder is located adjacent the highest point of the deck, i.e. adjacent the junction of the inlet end and the high side of the deck. This is advantageous because any build up of material will create an artificial slope which is in the same direction as the slope of the deck. Therefore, the artificial slope will work with the slope of the deck to assist in the separation process. Additionally, by locating the feeder above the highest point of the deck, the deck length can be made shorter. For a given capacity separation occurs sooner because the lighter particles fall to the lower side faster.

DETAILED DESCRIPTION OF THE PREFERRED EMBODIMENTS

Figure 1:
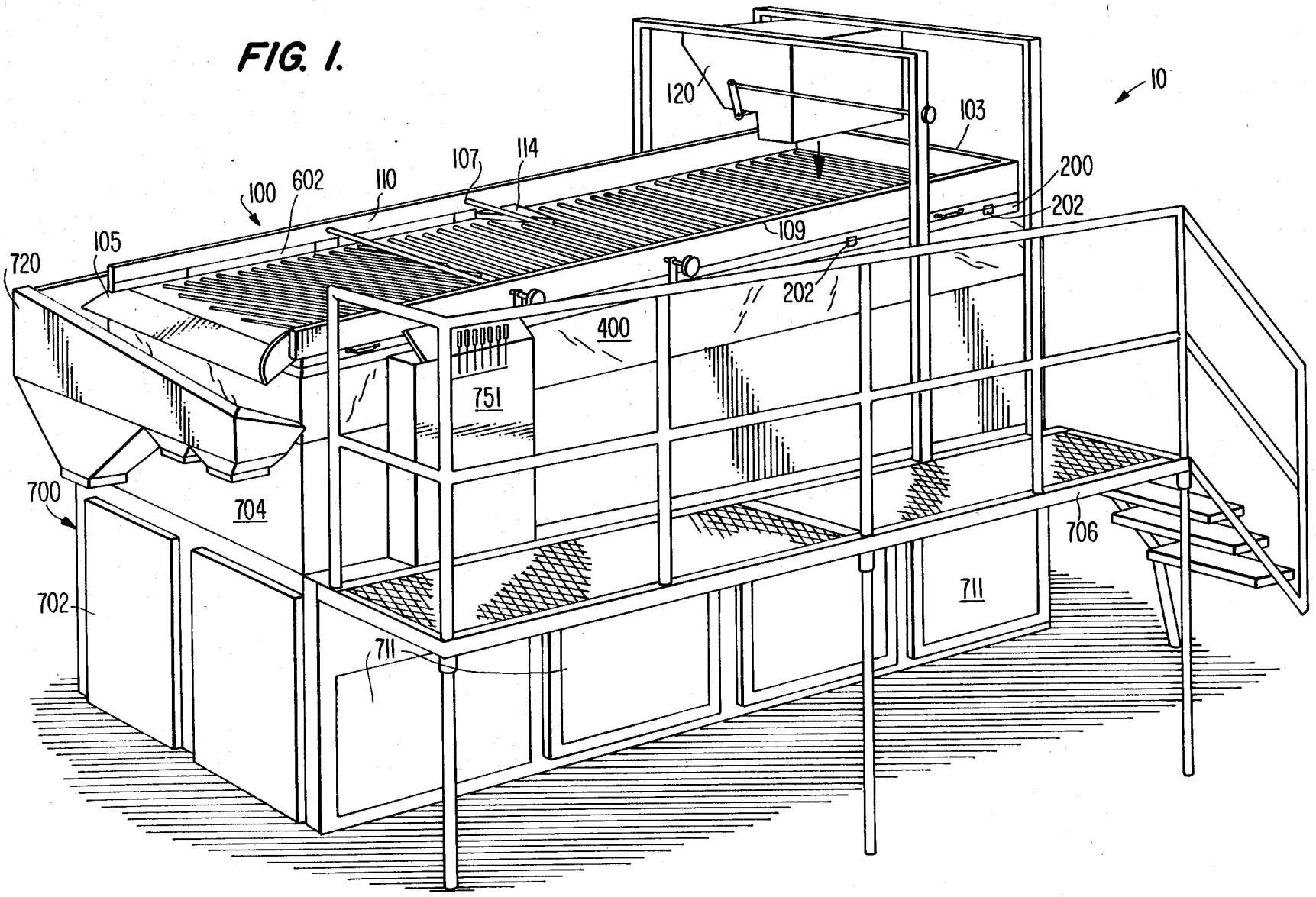
FIG. 1 is a front perspective view of a gravity separator in accordance with the invention.

The gravity separator in accordance with the present invention is illustrated in FIG. 1 and is generally designated 10. Separator 10 includes a support framework or housing 700 that supports the entire separator 10 on the ground. Framework 700 includes a lower section 702, an upper section 704 and an operator stand 706. A perforated separator deck 100 is supported for vibratory motion by a suspension assembly 300 in upper section 704 of framework 700. An eccentric drive assembly 500 is coupled to suspension assembly 300 to supply vibratory or agitating motion to separator deck 100. An upward air flow through separator deck 100 is provided by a plurality of fans supported inside lower section 702 of framework 700. A ribbon feeder 120 supplies particulate material to be separated to the deck, which is separated according to weight by the vibratory action of deck 100 and the air flow therethrough. The separated particulate material is discharged from deck 100 into a discharge hopper 720. A control console 51 is attached to framework 700 at a location along operator stand 706.

Figure 2:
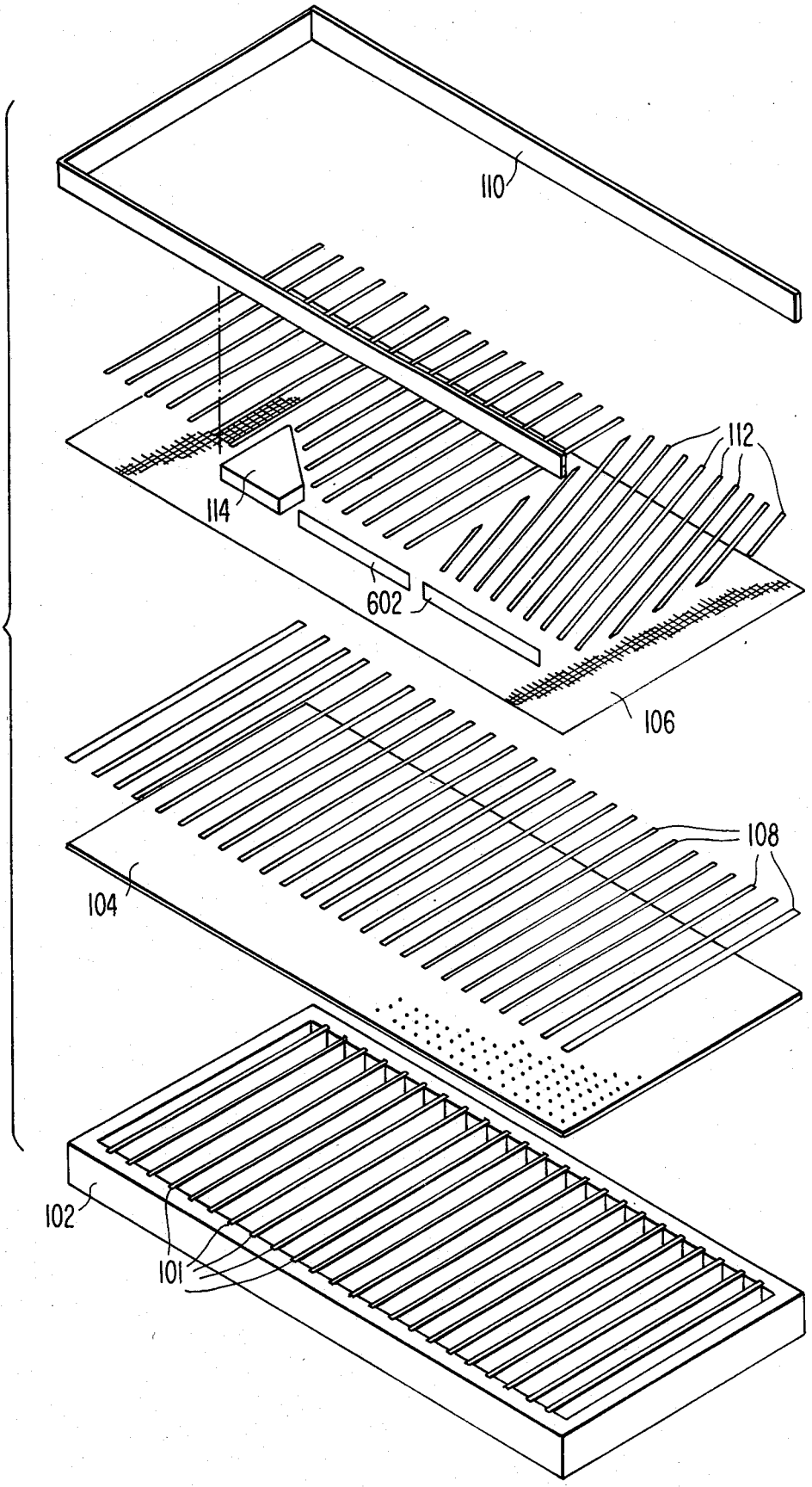
FIG. 2 is an exploded perspective view of the separator deck.
Figure 3:
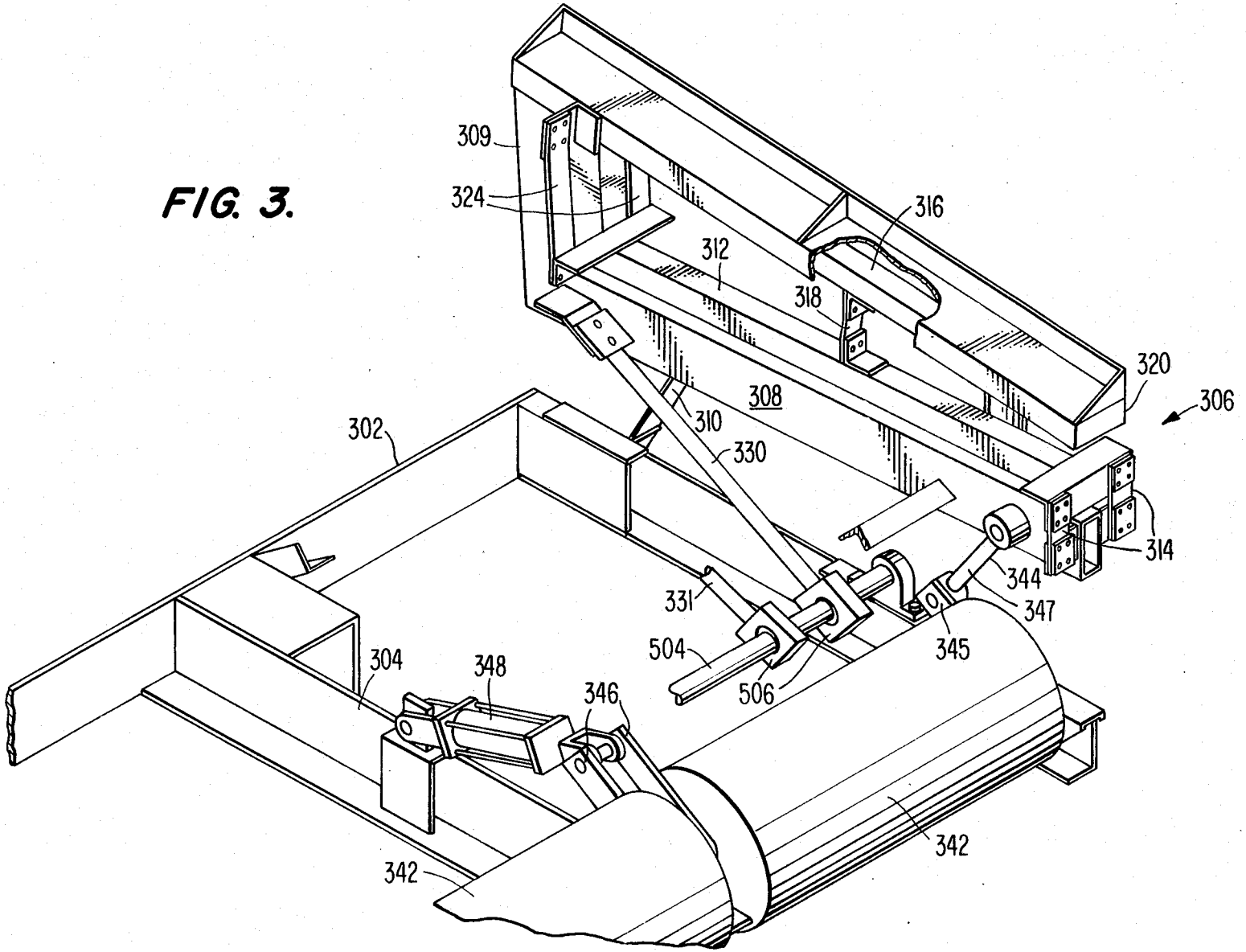
FIG. 3 is a partial perspective view illustrating the end raise and side tilt adjustment mechanisms in accordance with the invention.

Separator deck 100 is constructed of perforated materials to allow a controlled air flow to pass upwardly through it. Separator deck 100 is preferably rectangular in shape, having a length dimension of approximately two to three times as great as the width dimension. Other shaped decks could also be used. As seen in FIG. 2, separator deck 100 is formed of a rectangular frame 102 with transverse support ribs 101 providing structural support for the deck. Frame 102 is preferably made of aluminimum to conserve weight. A perforated undercover 104, which develops a specific back pressure to create a uniform air flow over the entire deck surface, is attached over frame 102 and ribs 101. A woven overcover 106 is located above the undercover 104 and contacts the material being separated and provides a sufficient amount of friction with the material to cause the separation. Undercover 104 and overcover 106 are separated by spacers or parting strips 108. Trim 110 is attached above the separating surface to prevent spillage and provide flow control. Riffles 112 are provided on the separator deck. A rock trap 114 is also provided to separate rocks from a particulate material, such as grain, deposited on the deck. Since the rocks are heavy compared to the grain, they are separated from the grain quickly at rock trap 114 on high side 107. Gates 602, which are part of a blender assembly, are also located at the separator deck surface. The function of gates 602 is described below in connection with the blender assembly.

Figure 10:
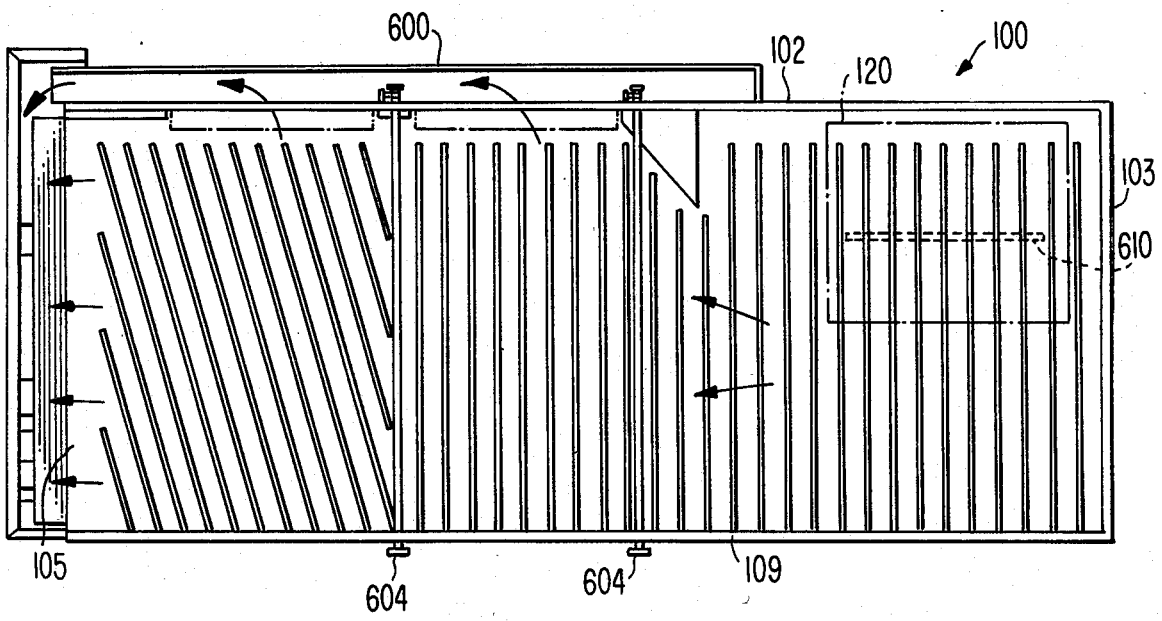
FIG. 10 is a top plan view of the separator deck.

As shown in FIG. 10, separator deck 100 has an inlet end 103, and outlet end 105, a first high side 107 and a second low side 109. Sides 107, 109 extend longitudinally between ends 103 and 105. Suspension assembly 300 supports separator deck 100 with inlet end 103 elevated above outlet end 105, defining the end raise of the deck, and with first side 107 elevated above second side 109, defining the side tilt of the deck. Separator deck 100 is removably attached to a rectangular deck carriage support 200 by clamps, shown diagrammatically as 202.

The separator deck is fed by ribbon feeder 120 located above the highest pint of the deck, adjacent the corner of inlet end 103 and first side 107. The feeder is located above the highest point of the deck to assist in separation, thereby reducing separation time and allowing for the use of a shorter deck. By depositing a ribbon (much longer than wide), of material 610 (FIG. 10) on the high side with the lengthwise dimension of the ribbon extending in the direction of the length of deck 100, the lighter material separates sooner by falling to the low side faster. Also, if material builds up on the high side, which can occur at high feed rates, an artificial slope is created which works with the slope of the deck to assist in the separation process, i.e., the material builds up at the high side and slopes downward to the low side. This enables the deck to have a greater capacity.

Removable separating deck 100 is supported by suspension assembly 300 and is vibrated by eccentirc drive assembly 500. An end raise adjustment mechanism 306 hydraulically adjusts the end raise; and a side tilt adjustment mechanism 340 hydraulically adjusts the side tilt. Suspension assembly 300, drive assembly 500 and adjustment mechanisms 306 and 340 will be discussed in detail later.

Figure 12:
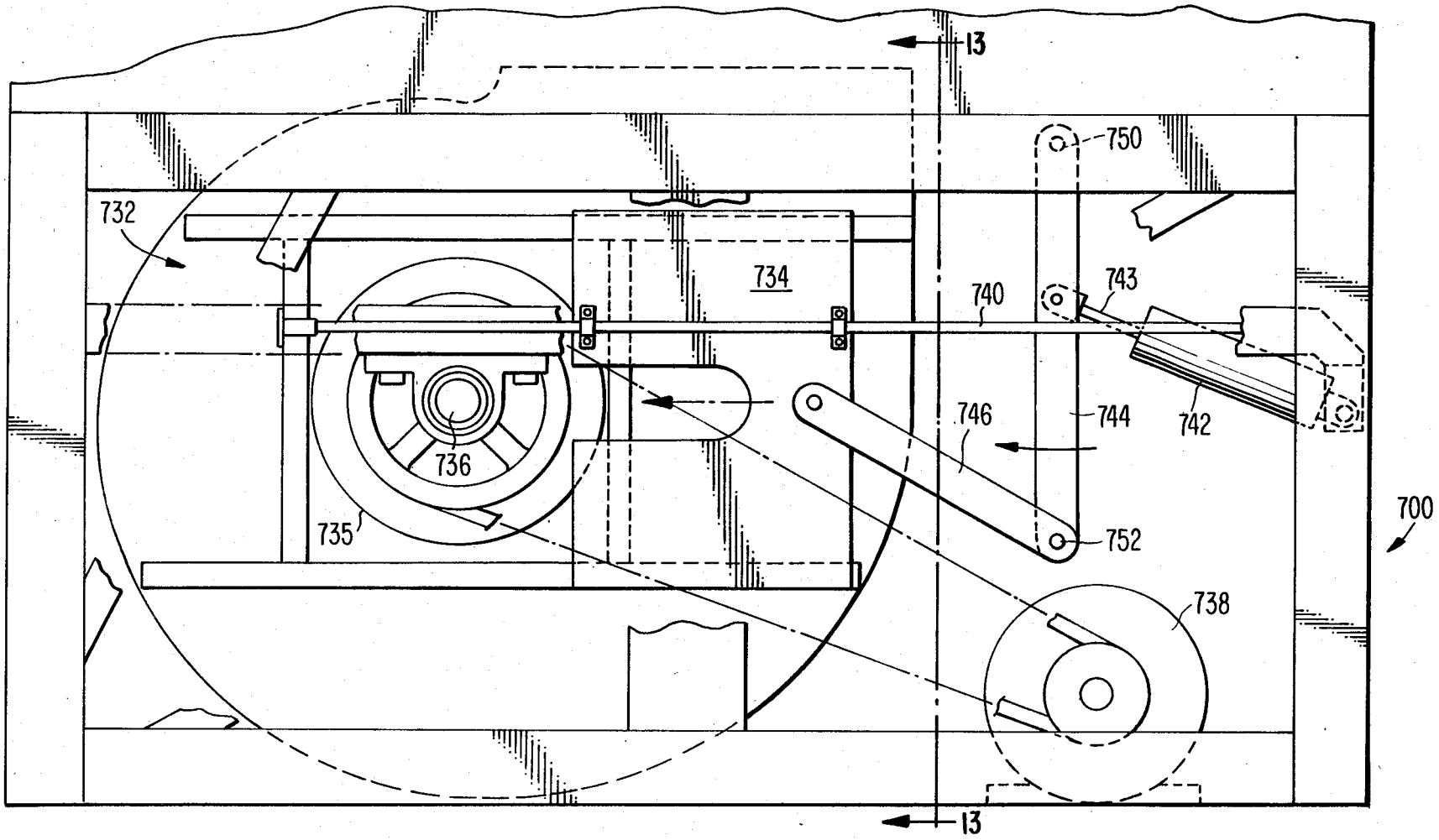
FIG. 12 is a partial end view, partially broken away, illustrating a blower fan and drive motor.
Figure 13:
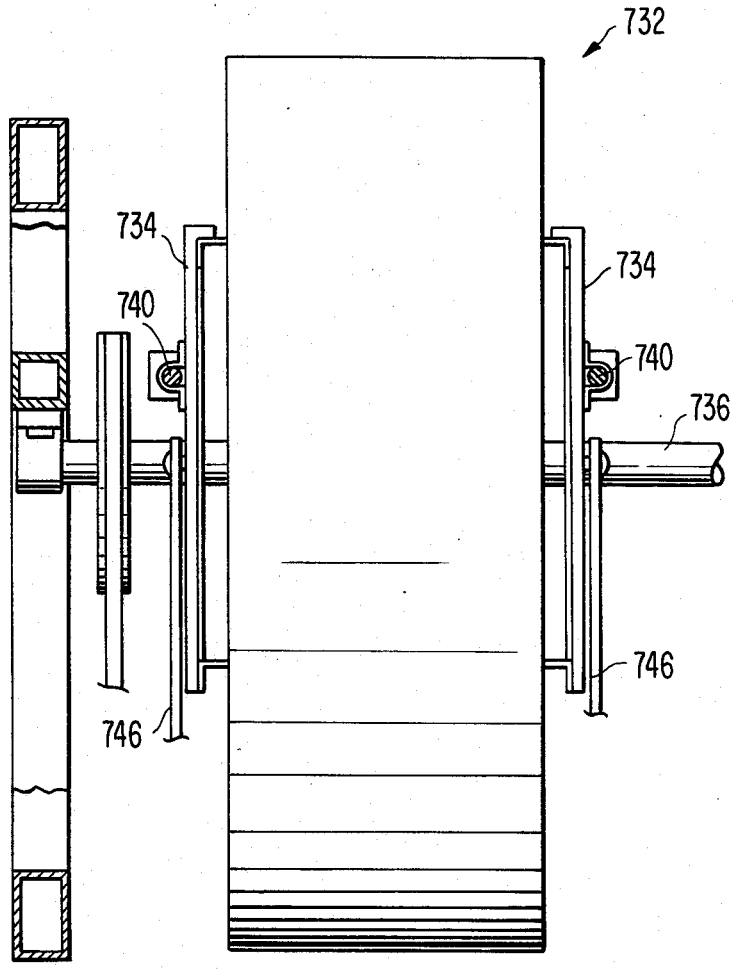
FIG. 13 is a cross-sectional view taken along line 13—13 of FIG. 12.

An air supply system, which includes one or more fans, is supported within lower portion 702 of support framework 700. In a preferred embodiment a plurality of fans 732 are used. A plurality of screens 711 are disposed around lower portion 702 to admit air into the interior of framework 700. One of the plurality of fans 732 is illustrated in FIGS. 12 and 13. Fans 732 are mounted on a common drive shaft 736 and are driven by a single motor 738 to operate at the same speed. Each fan 732 supplies air to a particular area of separator deck 100 and each fan is independently adjustable to ensure that the optimal amount of air is supplied. Independent fine air adjustment is controlled by opening and closing a baffle or air gate 734 on both sides of fan 732 to vary the size of the inlet opening 735 on both sides of the fan housing. Air gates 734 are slideably attached to cylindrical rods 740. The opening and closing of air gates 734 to each fan 732 are controlled by a hydraulic jack 742. The motion of a piston rod 743 of hydraulic jack 742 is transmitted to gate 734 through a linkage comprised of a rigid arm 744, which is hingedly connected at one end to a part of the framework 700 by hinge 750 and at its other end, through a hinge 752, to a second rigid arm 746, which in turn is pivotably attached to gate 734. Opening the air gate increases the volume of air supplied and closing the air gate decreases the volume of air supplied. Course air volume adjustments can be controlled by changing the diameter of the main drive sheave on the motor 738. The general range of air volume for a particular material can be selected by attaching the appropriate size drive sheave. Thereafter individual fine adjustments can be made to vary the air volume from each separate fan by an operator standing at control console 751 and operating hydraulic jacks 742.

An air chest assembly 400 formed of a flexible material such as canvas surrounds framework 700 in the area between vibrating deck carriage 200 and the stationary upper portion 704 of framework 700. Air chest 400 provides the air seal between the moving deck carriage and the fixed portions of the machine. The air chest assembly thus directs and confines the air to provide the proper amount of air to separator deck 100.

The combined action of the vibration of separator deck 100 and the upward flow of air through deck 100 forces lighter material to the top of the bed of material on deck 100 and the heavier material sinks to the bottom, i.e., vertical stratification. The horizontal component of the vibration or agitation thereafter further enhances separation by conveying the heavier material toward the uphill side 107 of deck 100. The net effect of the agitated deck, the sloping deck surface and the controlled air flow converts the vertically stratified bed of material into a horizontal separation which varies from the heaviest particles at the high side 107 of the deck surface ranging down to the lightest particles located at the lowest point on the deck surface. Concurrently, with the horizontal stratification, all the material is being conveyed downhill from the high inlet end 103 to discharge hopper 720 at the low outlet side 105. Discharge hopper 720 collects the graded materials which travel in the direction of the arrows seen in FIG. 9, and divides it into two or three fractions, for example, heavy, middle and light for final discharge from the machine. It provides a convenient place to attach additional conveying or packaging equipment for further processing or handling of the material after it has been separated.

Figure 9:
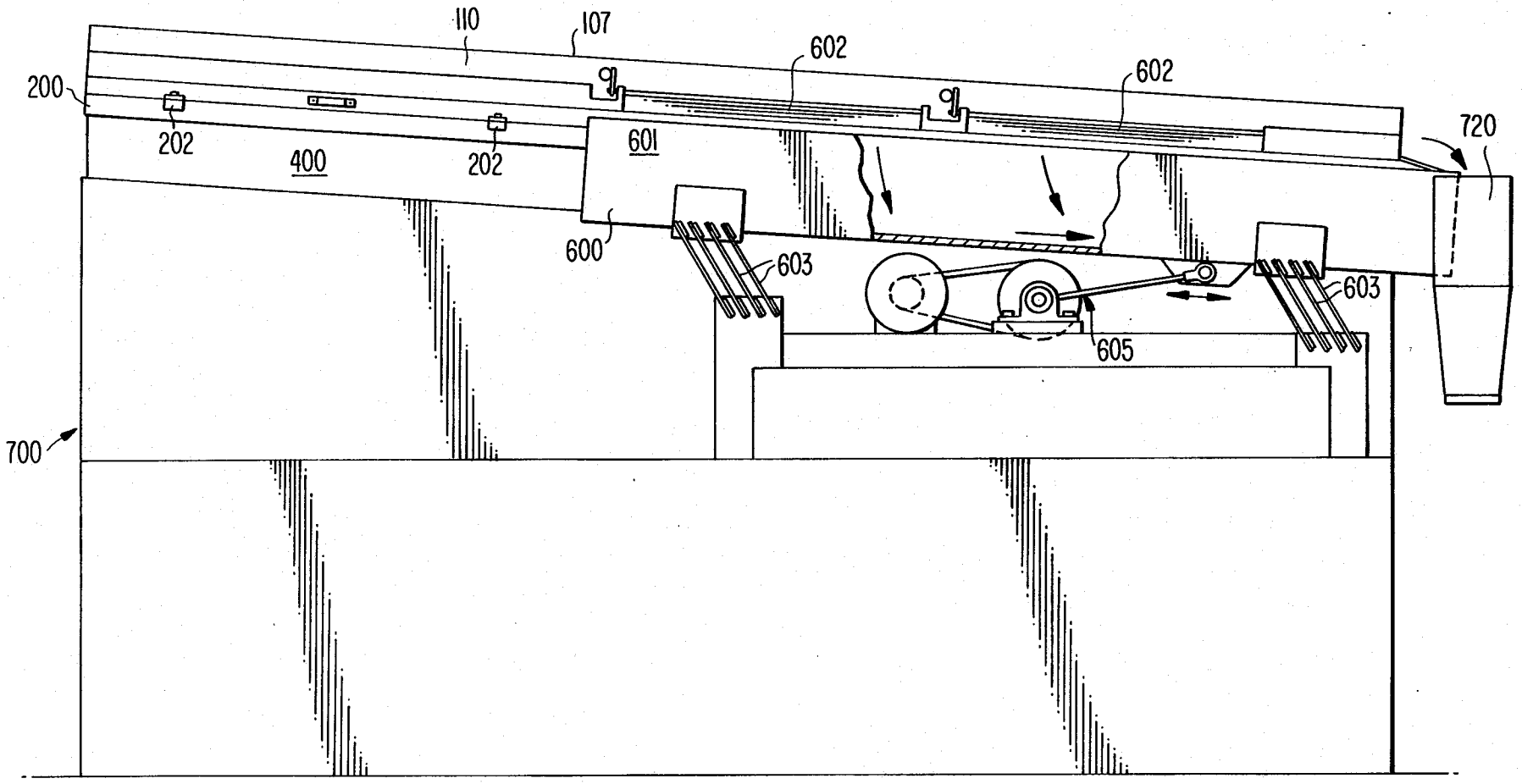
FIG. 9 is a rear side view illustrating a blender assembly.

In addition to the heavy material discharging off the high portion of discharge end 105 of deck 100, additional material can be selectively taken off high side 107 through a blender assembly 600 and blended with heavy material passing into discharge hopper 720 over end 105. FIGS. 9-11 show the blender assembly 600 which is supported on the main frame of the machine. As material is separated on the separating deck, it is graded into a product which varies in density from the heaviest material to the very lightest. The blender assembly accomplishes a more efficient recovery of heavy material from the highest side of the deck and conveys it to discharge assembly 720. Blender assembly 600 includes a trough 601, gates 602, leaf springs 603 and an eccentric drive 605. Leaf springs 603 support trough 601 for vibratory motion on framework 700. Gates 602 are pivotable to vary one or more openings along high side 107 and control the amount of material accepted by trough 601 of blender assembly 600. The more material accepted, the faster the separation time can be and faster separation time allows for a shorter separator deck. The amount blender assembly 600 is used depends upon the type of material being conveyed and the manner in which the separator is operating. Such blender control is conventional in the art. Once separated material is received in trough 601 it is conveyed to discharge hopper 720 by the vibratory motion caused by eccentric drive 605.

Figure 11A:
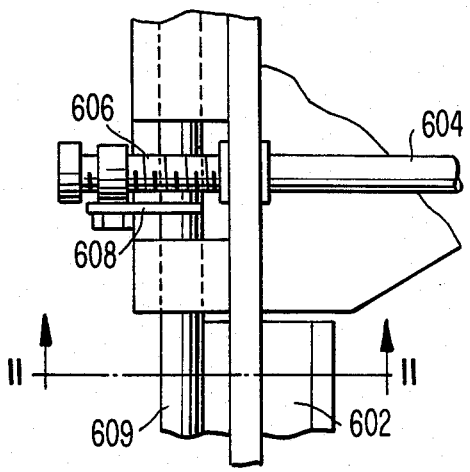
FIG. 11*a* is an enlarged top plan view illustrating an actuator for a discharge gate to the blender.
Figure 11B:
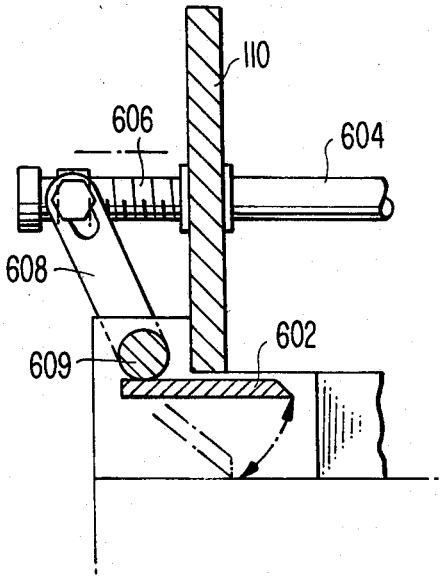
FIG. 11*b* is a view taken generally along line 11—11 of FIG. 11*a*.

In operation, the gates 602 are opened and closed by use of manually adjustable cranks 604 which extend across deck 100. The crank is operated from the side of the deck where the operator would stand, in front of control panel 751. FIGS. 11*a* and 11*b* show the operation of the crank to control the pivot of the gates. As crank 604 is rotated, the threaded member 606 is moved inwardly or outwardly thereby displacing a connecting member 608 which is connected at one end to threaded member 606 and at its other end to a rotatable rod 609, to which gate 602 is attached. The displacement of threaded member 606 rotates rod 609 to open and close gate 602.

Figure 8:
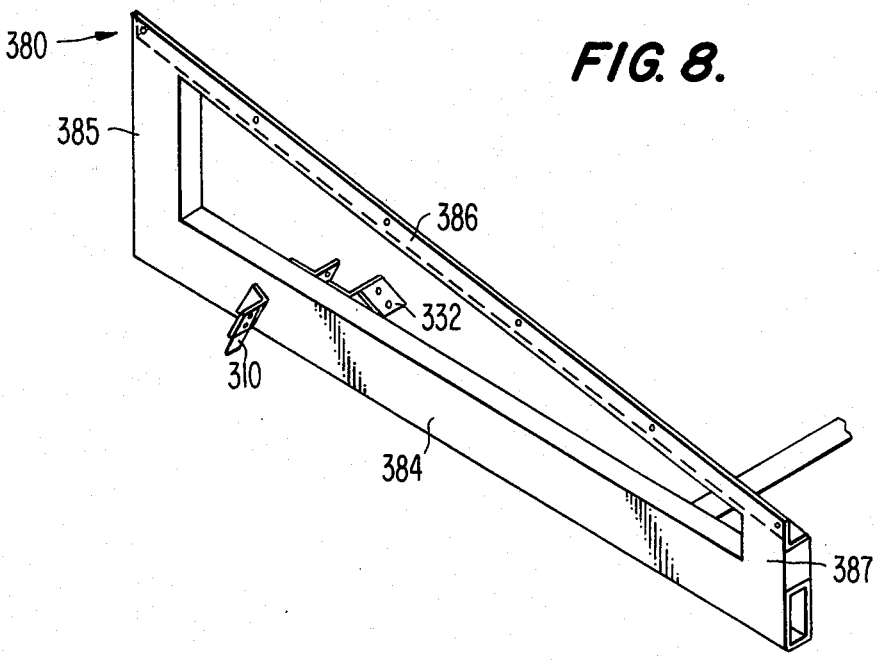
FIG. 8 is a perspective view of a discharge end support unit for the separator deck.

Suspension assembly 300 includes a discharge end support unit 380 (FIG. 8) and an end raise mechanism 306 (FIGS. 3-6). The discharge end of deck carriage 200 is bolted to a top member 386 of end unit 380 through a flexible metal strip and the inlet end of deck carriage 200 is attached to a top member 320 of end raise mechanism 306. Top member 386 of end unit 380 is connected to a bottom member 384 through a long post 385 at one end of members 384, 386 and a short post 387 at the other end of members 384, 386. In this manner, one side of deck 100, high side 107, is supported above the other side 109 to define a basic side tilt of deck 100. Top member 320 is similarly supported an an angle with respect to a bottom member 308 of end raise mechanism 306 by a pair of hydraulic jacks 326, one of which is connected to bottom member 308 at a lower position than the other jack to define the same basic side tilt. A side tilt adjustment mechanism 340, which will be discussed in detail, later adjusts the amount of side tilt. A frame 302, preferably rectangular in shape and having crossbars 302 extending laterally across the rectangle, is supported in upper section 704 of framework 700. End raise mechanism 306 extends laterally across inlet end 103, and in addition to supporting inlet end 103 of deck 100, adjusts the angle of the separator deck in the primary direction of flow of material across the device, i.e. adjusts the end raise. End raise mechanism 306 includes bottom member 308 which is coupled to a side of support frame 302 through a leaf spring 310 and a torque are 344 of side tilt adjustment mechanism 340. End unit 380 is similarly supported on framework 700 by another leaf spring 310 attached to its bottom member 384 and another torque arm at the other end of side tilt adjustment mechanism 340.

In addition to top member 320, bottom member 308 and hydraulic jacks 326, end raise mechanism 306 includes a linkage mechanism formed of an equalizer member 312 and a thrust member 316. Equalizer member 312 is hingedly connected at one end to bottom member 308 through a leaf spring hinge 314 and hingedly connected at its other end to top member 320 through a leaf spring hinge 324. Equalizer member 312 is also hingedly connected to thrust member 316 through a leaf spring hinge 318 located intermediate the ends of equalizer member 312. Equalizer member 312 keeps the angle between top member 320 and bottom member 302; i.e., the side tilt, unchanged when an end raise adjustment is made. The leaf springs are preferably formed of high tensile fiberglass.

Thrust member 316 is hingedly connected at one end to top member 320 through a leaf spring hinge 322 and to bottom member 308 at the other end through a leaf spring hinge 328. Hinge 328 is attached to the top end of a post 309 extending upward from one end of bottom member 308, and hinge 322 is attached to the bottom end of a post 321 extending downward from one end of top member 320. In this manner, hinges 322 and 328, which are preferably high tensile fiberglass leaf springs, are aligned with the longitudinal dimension of thrust member 316. Thrust member 316 transmits the agitation from the eccentric assembly 500 to the deck through hinges 328, 322 and top member 320. The thrust member transmits the motion accurately and does not allow any unwanted motion to be developed in the transmission of agitation.

Figure 4:
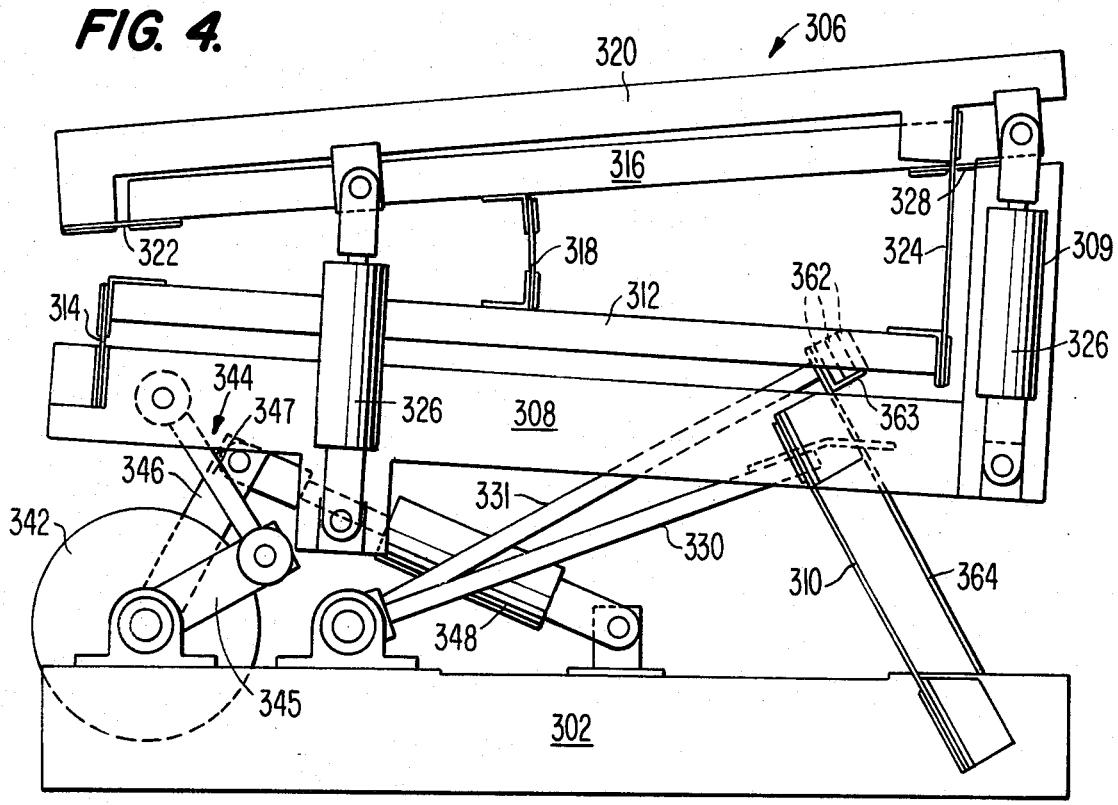
FIG. 4 is an end view of the end raise and side tilt adjustment mechanisms in lowered positions to minimize end raise and maximize side tilt.
Figure 5:
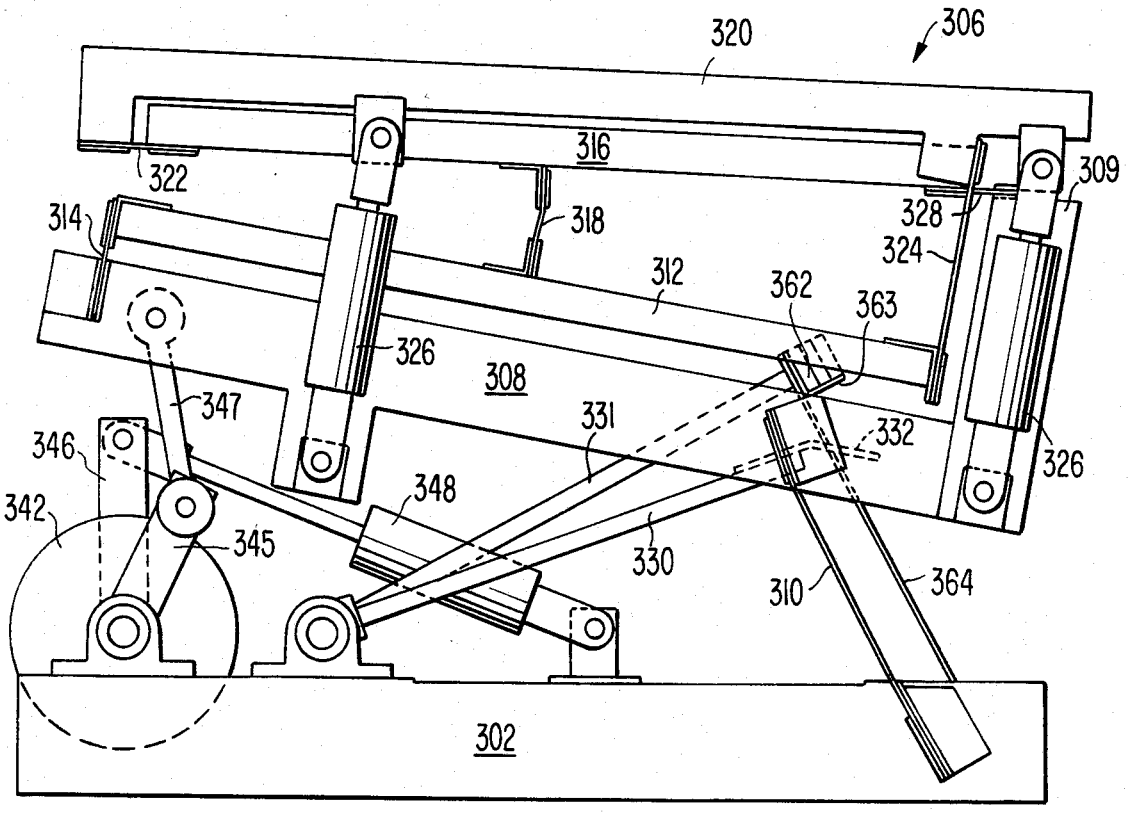
FIG. 5 is an end view similar to FIG. 4 with the side tilt mechanism moved upward to reduce side tilt.
Figure 6:
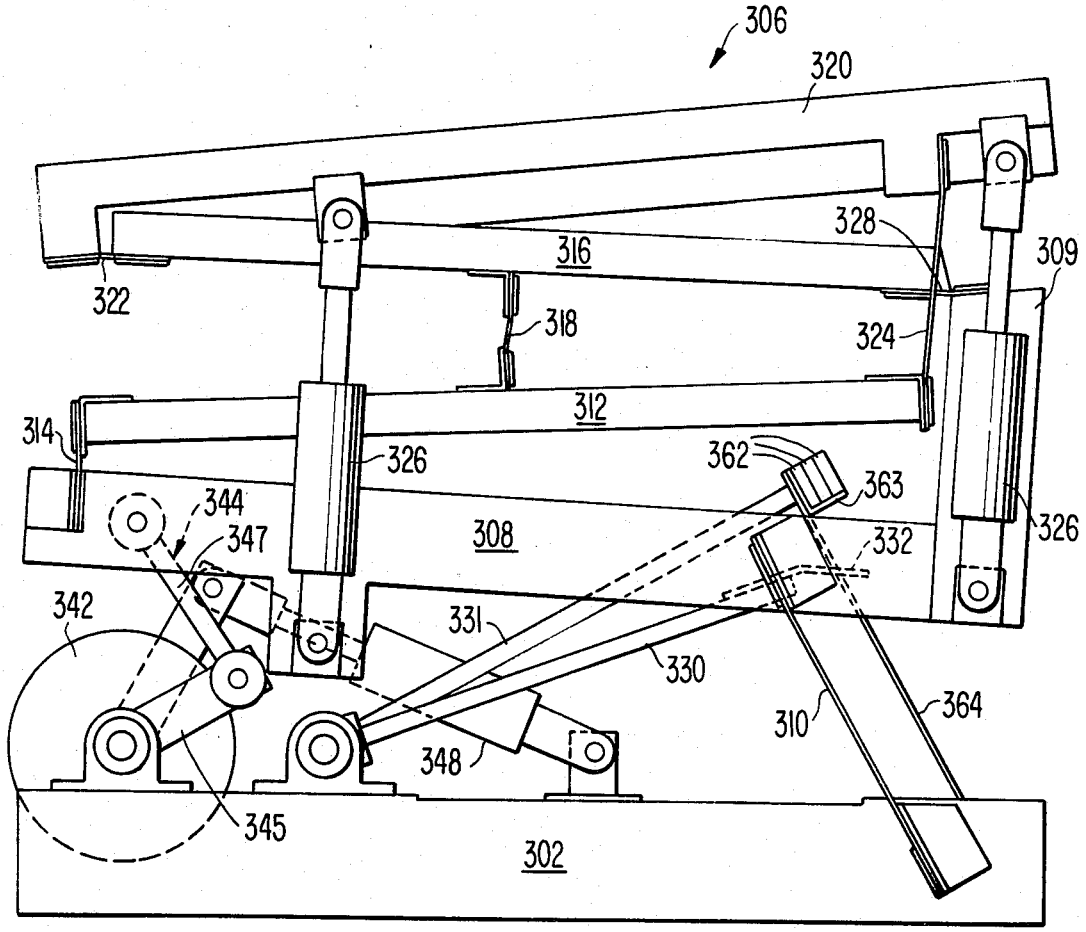
FIG. 6 is an end view similar to FIG. 4 with the end raise mechanism moved upward to increase end raise.

As seen in FIGS. 4-6, hydraulic jacks 326 extend vertically between top member 320 and bottom member 308. Operation of jacks 326 creates the vertical movement of top member 320 relative to bottom member 308 which provides the end raise adjustment. Jacks 326 are operated from control console 751. The jacks can be operated during operation of the separator without the requirement of loosening and securing clamps. After adjustment, the jacks and the hydraulic circuit hold the end raise in position in a convential manner. The end raise adjustment provides one variable for controlling the rate of separation as the material travels across the deck. A comparison of FIGS. 4 and 6 illustrates the operation of end raise, adjustment mechanism 306. In FIG. 4, the piston rods of hydraulic jacks 326 are retracted so that the end raise of the separator deck is minimized, while in FIG. 6, the piston rods of hydraulic jack 326 are extended to maximize end raise.

Side tilt adjustment mechanism 340 adjusts the slope angle or side tilt of the separator deck in the same plane as the direction of agitation. Side tilt adjustment mechanism 340 includes preferably a rotatable member formed of large diameter cylinders 342 which are rotatable in unison about their longitudinal axes for producing torque which provides the side tilt adjustment. A torque arm 344, comprised of first and second links 345 and 347, extends from a far end of each cylinder 342 to couple the cylinders to end raise mechanism 306 and support unit 380. Bearings are inserted between links 345 and 347, and between link 347 and bottom member 308 to permit the vibratory motion of end raise mechanism 306 and support unit 380. Torque arms 344 thus transmit the desired vertical movement for tilt adjustment to the separator deck by translating rotary motion of cylinders 342 into vertical movement of ends of torque arms 344. An actuator arm 346 connects the other end of each cylinder 342 to a hydraulic jack 348. Hydraulic jack 348 is mounted on cross bar 304 and drives the rotation of cylinders 342. The diameter and wall thickness of the cylinders are selected to give a minimal torsional deflection and produce exactly the same movement at both ends of the cylinder. As side tilt of the deck is increased by lowering torque arm 344, it is more difficult to convey the heavier material uphill. Decreasing the side tilt angle makes easier to convey the heavy product uphill. The side tilt adjustment provides one variable in controlling the rate of separation of material as it moves across the deck. A comparison of FIGS. 4 and 5 illustrates the operation of side tilt adjustment mechanism 340. In FIG. 4, the piston rod of jack 348 is retracted and torque arm 344 is rotated to a lower position, maximizing side tilt, while in FIG. 5 torque arm 344 is rotated to an upper position, minimizing side tilt. Hydralic jack 348 is likewise operated at control console 751. This operation can also occur during vibration of deck 100 without the requirement of loosening and securing clamps.

Figure 7:
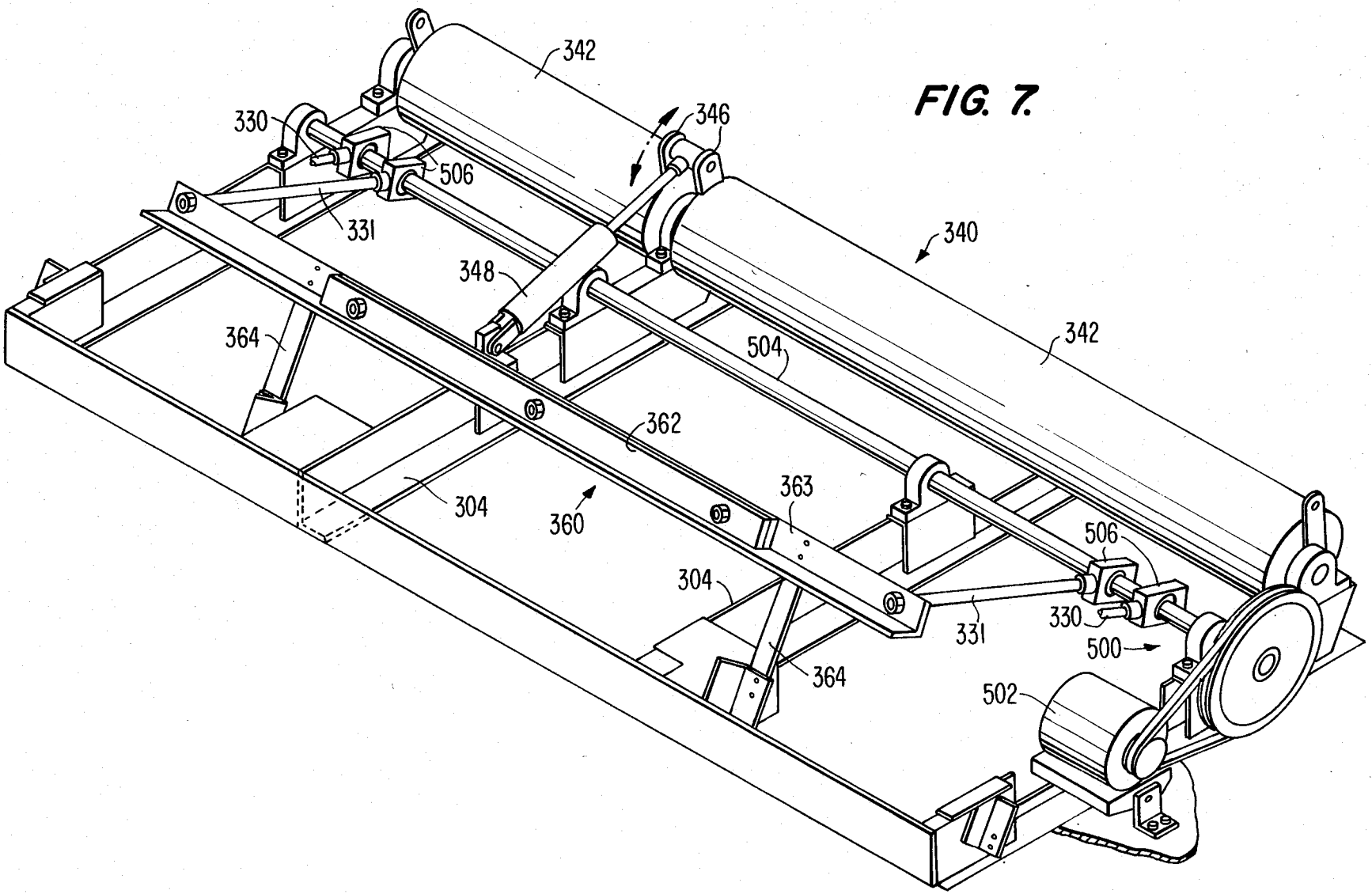
FIG. 7 is a perspective view illustrating the side tilt mechanism, the eccentric drive, and a counterweight assembly.

A counterbalance mechanism 360, as seen in FIG. 7, includes a large variable weight 362 which is mounted on an angle iron 363, which in turn is supported on framework 700 through leaf springs 364 connected to crossbars 304. The large weight is agitated by eccentric drive assembly 500 in a manner to oppose and negate the affects of the vibrating deck assembly. The weight is agitated by eccentric drive assembly 500 180° out of phase with the agitation of the separator deck. This prevents unwanted vibrations from being transmitted to the frame and structure surrounding the machine. It makes installation and operation of the machine much simpler and provides for a smoother, quieter operation.

Eccentric drive assembly 500 is mounted on frame 302 and includes a motor 502, at driven shaft 504, a plurality of bearings 506 with eccentric hearts, and push rods 330 and 331. Eccentric drive assembly provides the agitation or vibration for both separator deck 100 and counterbalance assembly 360. Motor 502 rotates driven shaft 504. The rotation of shaft 504 is converted into linear motion by bearings 506, which include eccentric hearts, for producing a forward and backward motion to push rods 330 and 331 which are coupled to the eccentric hearts. Push rods 330 serve as reciprocating members and are connected to the bottom members of the suspension assembly through flanges 332 to transmit vibratory motion to separator deck 100. Push rods 331 are connected to counterbalance assembly 360 through flanges 367, and to eccentrics 506 with eccentric hearts 180° out of phase which the hearts of bearings 506 connected to push rods 330. Rotational speed of shaft 504 is controlled by any conventional means such as a variable speed sheave coupled between driven shaft 504 and the drive shaft of motor 502

All machine operational adjustments including end raise, side tilt, eccentric drive assembly speed and air volume of the independently controlled fans are accomplished through the use of hydraulics. The adjustments, particularly end raise and side tilt, may be accomplished without stopping the machine. The prime mover for the hydraulic system is a pump - motor combination (not shown) which delivers all hydraulic fluid necessary to operate the controls in a conventional manner. From the pump, the hydraulic fluid flows through a bank valve or a control console 751 which contains a conventional hydraulic control circuit capable of delivering fluid to each control function independently. Actual movement of the control variables is accomplished by means of a small hydraulic valve which opens and closes on demand from the control console 751. The control console 751 is conveniently located at the proper location for best viewing of the product during separation. This allows for all adjustments to be made at one location and allows for settings to be at their optimum value to obtain the best separation. The particular settings of the rate of feed, end raise or inclination of the deck, agitation of the deck or speed of the eccentric drive, slope of side tilt of the deck and air volume control to obtain proper separation for a specific particulate material would be evident to one skilled in this art.

The foregoing is for illustrative purposes only. Changes may be made, obvious to one of ordinary skill in the art, particularly in regard to size, shape, and arrangement of parts, within the scope of the invention as determined by the broad, general terms in which the appended claims are expressed.

I claim:

1. In a gravity separator for separating heavier particulate material from lighter particulate material on a vibrating separator deck, the separator deck being supported on a support framework for vibratory motion with respect to said framework with an inlet end of the deck elevated with respect to an outlet and of the deck to define an end raise and with a first side of the deck elevated with respect to a second side of the deck to define a side tilt, suspension and adjustment mechanisms comprising:

a suspension assembly comprising a discharge end support unit for supporting the discharge end of the separator deck and end raise adjusting means for supporting an input end of the separator deck and adjusting the end raise of the separator deck;

said end raise adjusting means including a bottom member, a top member spaced above said bottom member for supporting the inlet end of the separator, at least one hydraulic jack connected between said top and bottom member to move said top member with respect to said bottom member, a thrust member for transmitting vibratory thrust from said bottom member to said top member, said thrust member being hingedly connected at one end to said top member and at the other end to said bottom member, an equalizer member for keeping the tilt angle between said top and bottom members equal during adjusting motion of said at least one hydraulic jack, one end of said equalizer member being hingedly connected to said bottom member, the other end of said equalizer member being hingedly connected to said top member, and a portion of said equalizer member between its opposite ends being hingedly connected to a portion of said thrust member; and side tilt adjustment means for adjusting the side tilt of the separator deck including a rotatable member extending between opposite ends of the separator deck, a torque arm extending from each end of said rotatable member, one of said torque arms being coupled to said discharge end support unit and the other of said torque arms being coupled to said bottom member of said end raise adjusting means, and means for rotating said rotatable member to adjust the position of said torque arms and the side tilt of the separator deck.

2. A gravity separator in accordance with claim 1 wherein leaf springs form said hinged connections.

3. A gravity separator in accordance with claim 2 wherein the leaf spring of said hinged connection between said thrust member and said top and bottom members extends generally in the longitudinal direction of said thrust member.

4. A gravity separator for separating heavier particulate material from lighter particulate material comprising:

a support framework;

a separator deck having an inlet end, an outlet end and first and second sides extending between said inlet and outlet ends;

a suspension assembly for supporting said separator deck on said framework for vibratory motion with respect to said framework, with said inlet end of said deck elevated with respect to said outlet end of said deck to define an end raise and with said first side of said deck elevated with respect to said second side of said deck to define a side tilt, said suspension assembly including a discharge end support unit for supporting the discharge end of separator deck and hydraulic end raise adjusting means for supporting the input end of said separator deck and adjusting said end raise of said separator deck;

means for vibrating said separator deck;

hydraulic side tilt adjusting means for adjusting the side tilt of said separator deck, said side tilt adjusting means connecting said discharge end support unit and said end raise adjusting means to said support framework along said second side of said separator deck;

leaf springs connecting said discharge end support unit and said end raise adjusting means to said support framework along said first side of said separator deck; and said end raise adjusting means comprising a bottom member coupled to said support framework through one of said leaf springs and said side tilt adjusting means, a top member spaced above said bottom member for carrying said separator deck, at least one hydraulic jack connected between said top and bottom member for moving said top member with respect to said bottom member, and linkage means coupled between said top and bottom members, said linkage means including a thrust member for transmitting vibratory thrust from said bottom member to said top member, said thrust member being hingedly connected at one end of said top member and at the other end of said bottom member, and an equalizer member for keeping the tilt angle between said top and bottom member equal during adjustment motion of said end raise, one end of said equalizer member being hingedly connected to said bottom member, the other end of said equalizer member being hingedly connected to said top member, and a portion of said equalizer member between its opposite ends being hingedly connected to a portion of said thrust member.

5. a gravity separator in accordance with claim 4 wherein leaf springs form said hinged connections.

6. A gravity separator in accordance with claim 5 wherein the leaf spring of said hinged connections between said thrust member and said top and bottom members extend generally in the longitudinal direction of said thrust member.

7. A gravity separator in accordance with claim 4 wherein said side tilt adjusting means comprises a rotatable member extending between opposite ends of said separator deck, a torque arm extending from each end of said rotatable member, each torque arm being connected to said suspension assembly, and hydraulic means for rotating said rotatable member to adjust the positions of said torque arms and the side tilt of said separator deck.

8. A gravity separator in accordance with claim 7 wherein said rotatable member comprises a pair of cylinders rotatably supported on said support framework, one of said torque arms being pivoted by one of said cylinders and being connected to said discharge end support unit, the other of said torque arms being pivoted by the other of said cylinders and being connected to said bottom member of said end raise adjusting means, and said means of rotating said rotatable member includes a hydraulic jack coupled to said cylinders at a location between said cylinders by an actuator arm.

9. A gravity separator for separating heavier particulate material from lighter particulate material comprising:

a support framework;

a separator deck having an inlet end, an outlet end and first and second sides extending between said inlet and outlet ends;

a suspension assembly for supporting said separator deck on said framework for vibratory motion with respect to said framework, with said inlet end of said deck elevated with respect to said outlet end of said deck to define an end raise and with said first side of said deck elevated with respect to said second side of said deck to define a side tilt, said suspension assembly including a discharge end support for supporting the discharge end of said separator deck and hydraulic end raise adjusting means for supporting the input end of said separator deck and for adjusting said end raise of said separator deck;

means for vibrating said separator deck; and hydraulic side tilt adjusting means for adjusting the side tilt of said separator deck, said side tilt adjusting means comprising a rotatable member extending between opposite ends of said separator deck, a pair of torque arms extending from said rotatable member, each torque arm being connected to said suspension assembly, and hydraulic means for rotating said rotatable member to adjust the positions of said torque arms and the side tilt of said separator deck.

10. A gravity separator in accordance with claim 9 wherein said discharge end support unit and said end raise adjusting means are connected to said support framework along said second side of said separating deck through said tilt adjusting means and along said first side of said separating deck by leaf springs.

11. A gravity separator in accordance with claim 10 wherein said end raise adjusting means comprises:

a bottom member coupled to said support framework through one of said leaf springs and said side tilt adjusting means;

a top member spaced above said bottom member for carrying said separator deck;

at least one hydraulic jack connected between said top and bottom member for moving said top member with respect to said bottom member; and linkage means coupled between said top and bottom members for transmitting vibratory thrust from vibrating means from said bottom member to said top member and for keeping the tilt angle between said top and bottom member equal during adjustment motion of said end raise by said at least one hydraulic jack.

12. A gravity separator in accordance with claim 11 wherein said linkage means comprises:

a thrust member for transmitting vibratory thrust from said bottom member to said top member, said thrust member being hingedly connected at one end of said top member and at the other end of said bottom member; and an equalizer member for keeping the tilt angle between said top and bottom member equal during adjustment motion of said end raise, one end of said equalizer member being hingedly connected to said bottom member, the other end of said equalizer member being hingedly connected to said top member, and a portion of said equalizer member between its opposite ends being hingedly connected to a portion of said thrust member.

13. A gravity separator in accordance with claim 9 wherein said rotatable member comprises a pair of cylinders rotatably supported on said support framework, one of said torque arms being pivoted by one of said cylinders and being connected to said discharge end support unit, the other of said torque arms being pivoted by the other of said cylinders and being connected to said end raise adjusting means; and said means for rotating said rotatable member includes a hydraulic jack coupled to said cylinders at a location between said cylinders by an actuator arm.

14. A gravity separator for separating heavier particulate material from lighter particulate material comprising:

a support framework;

a separator deck having an inlet end, an outlet end and first and second sides extending between said inlet and outlet ends;

a suspension assembly for supporting said separator deck on said framework for vibratory motion with respect to said framework, with said inlet end of said deck elevated with respect to said outlet end of said deck to define an end raise and with said first side of said deck elevated with respect to said second side of said deck to define a side tilt, said suspension assembly including a discharge end support unit for supporting the discharge end of said separator deck and end raise adjusting means for supporting the input end of said separator deck and adjusting said end raise, said end raise adjusting means including a bottom member coupled to said support framework, a top member spaced above said bottom member for carrying said separator deck and at least one hydraulic jack having a first portion connected to said to member and a second portion connected to and supported by said bottom member;

spring means for connecting said discharge end support unit and said end raise adjusting means to said support framework along said first side of said separating deck;

hydraulic side tilt adjusting means for adjusting the side tilt of said separator deck, said side tilt adjusting means connecting said discharge end support unit and said end raise adjusting means to said support framework along said second side of said separating deck; and means for vibrating said separator deck, said vibrating means being supported on said support framework and including a reciprocating member connected to said end raise adjusting means to vibrate in unison said bottom member, said first and second portions of said at least one hydraulic jack and said top member.

15. A gravity separator in accordance with claim 4 or 14 wherein said end raise adjusting means includes a pair of said hydraulic jacks connected between said top member and said bottom member.

16. A gravity separator in accordance with claim 4, 14 or 9 wherein said side tilt and end raise adjusting means is operable to be actuated while said vibrating means vibrates said separator deck.

17. A gravity separator in accordance with claim 4, 14 or 9 including counterbalance means connected to said support framework for vibrating a predetermined weight in a manner to oppose and negate the effects of the motion of said separator deck.

18. A gravity separator in accordance with claim 17 wherein vibration of said weight is substantially 180° out of phase with the vibration of said separator deck.

19. A gravity separator in accordance with claim 4, 14 or 9 wherein said separator deck is perforated and said separator includes air supply means for supplying air upwardly through said perforated separator deck.

20. A gravity separator in accordance with claim 19 wherein said air supply means includes a plurality of fans for supplying separate streams of air and means for controlling the volume of air supplied by each of said fans.

21. A gravity separator n accordance with claim 20 wherein said plurality of fans are mounted on a common drive shaft and operated at the same speed, and each of said fans supplies air to a particular area of said separator deck and is separately adjustable by baffle means to control the volume of air supplied to said separator deck.

22. A gravity separator in accordance with claim 4, 14 or 9 wherein a discharge hopper extends along substantially the entire width of said outlet end of said separator deck and includes at least two discharge chutes, one chute being located along the lower side of said outlet end for receiving light material and the other being located along the high side of said outlet end for receiving heavy particles, and including a blending means for accepting heavy material from the first high side of said separator deck as the material flows from one end of said separator deck to another end of said separator deck and blending the accepted heavy material with the heavy material discharging into said other chute of said discharge hopper.

23. A gravity separator in accordance with claim 22 wherein said blending means comprises a vibrating trough and at least one pivotable gate along said first side of said separator deck for varying an opening to control the amount of material accepted by said vibrating rough from said separator deck.

24. A gravity separator in accordance with claim 4, 14 or 9 including means for feeding the particulate material to a location on said separator decks adjacent the intersection of said inlet end and said first side.

* * * * *